United States Patent [19]

Kajihara et al.

[11] Patent Number: 4,616,996

[45] Date of Patent: Oct. 14, 1986

[54] NON-OXIDIZING ATMOSPHERE FIRING FURNACE FOR CERAMIC ARTICLES

[75] Inventors: Takehiro Kajihara, Komaki; Mitsugu Suzuki, Yokkaichi, both of Japan

[73] Assignee: NGK Insulators, Ltd., Japan

[21] Appl. No.: 766,719

[22] Filed: Aug. 19, 1985

[30] Foreign Application Priority Data

Aug. 31, 1984 [JP] Japan ..... 59-133255[U]

[51] Int. Cl.[4] ..... F27B 5/04; F27B 7/00; F27B 5/16; F27D 23/00

[52] U.S. Cl. ..... 432/148; 432/194; 432/198; 432/201; 432/249

[58] Field of Search ..... 432/148, 194, 198, 200, 432/201, 249

[56] References Cited

U.S. PATENT DOCUMENTS

| | | | |
|---|---|---|---|
| 4,193,761 | 3/1980 | Mantegani | 432/148 |
| 4,212,633 | 7/1980 | Kreider et al. | 432/259 |
| 4,365,954 | 12/1982 | Petzi | 432/201 |
| 4,543,060 | 9/1985 | Bowes | 432/198 |

*Primary Examiner*—John J. Camby
*Attorney, Agent, or Firm*—Parkhurst & Oliff

[57] ABSTRACT

A non-oxidizing firing furnace for ceramic articles, which comprises a furnace chamber filled with a non-oxidizing gas, a conveyor mechanism provided on the floor portion of the furnace chamber and adapted to move the ceramic articles oppositely to a direction in which the non-oxidizing gas is flown through the furnace chamber for firing the ceramic articles; and at least one partition wall with the surface being composed of molybdenum which partition wall is provided at the ceiling portion of the furnace chamber to define a low temperature zone on the inlet side for the ceramic articles and a high temperature zone.

18 Claims, 3 Drawing Figures

NON-OXIDIZING ATMOSPHERE FIRING FURNACE FOR CERAMIC ARTICLES

BACKGROUND OF THE INVENTION

Field of the Invention and Related Art Statement

The present invention relates to a furnace for firing ceramic articles, and more specifically the invention relates to a continuous firing furnace which is used for sintering alumina ceramics and the like in a non-oxidizing atmosphere.

In the sintering of ceramic articles, firing has been conventionally carried out in a non-oxidizing atmosphere, for instance, a reducing atmosphere of hydrogen gas, a neutral atmosphere of nitrogen or argon gas, or a neutral atmosphere under vacuum so as to enhance the mechanical strength of the ceramic articles increasing the sintering density, improving the sinterability, and rendering the ceramic articles translucent. For example, U.S. Pat. No. 3,026,210 and U.S. Pat. No. 3,792,142 disclose the production of discharge lamp tube in which a green shaped body containing magnesium oxide is sintered in a non-oxidizing atmosphere to obtain translucent alumina ceramics.

Alumina ceramics and beryllia ceramics used for electronic circuit substrates and packages in semiconductor elements cermet and nitride ceramics used for machining tools have historically been sintered in non-oxidizing atmospheres.

Heretofore, there has been known a non-oxidizing atmosphere furnace for continuously firing ceramic articles. More particularly, this furnace has a interior which is divided by partition walls made of refractory bricks, thereby forming a plurality of zones to result in appropriate temperature zones in the furnace chamber, and a non-oxidizing gas such as hydrogen gas, nitrogen gas or the like is flows reverse to a direction in which ceramic articles to be treated are to be moved.

Problems to be resolved by the Invention

However, according to such a conventional non-oxidizing atmosphere furnace, a component such as silica and magnesia contained in small amounts in a green shaped body to be sintered, and in furnace materials of refractory bricks, evaporates in the high temperature zone of the furnace chamber.

This evaporated component is carried to a low temperature zone while being entrained in the non-oxidizing gas, and then the evaporated component condenses upon contact with the partition wall of a lower temperature zone, so that the condensed component may drop onto an article which is being sintered. Since such drops contain impurities in which silica and magnesia react with the refractory bricks of the partition wall, serious consequences occur when the ceramic articles having such droppings move to the high temperature zone. The impurities evaporate again to contaminate the whole portion of the adjacent treated substance. Therefore, a non-oxidizing atmosphere furnace which is free from such contamination is a necessity.

SUMMARY OF THE INVENTION

It is an object of the present invention to provide a non-oxidizing atmosphere furnace which is free from the drawbacks encountered by the prior art.

More specifically, the object of the present invention is to provide a non-oxidizing atmosphere furnace which can avoid the contamination of ceramic articles.

According to the present invention, there is a provision of a non-oxidizing firing furnace for ceramic articles, which comprises a furnace chamber filled with a non-oxidizing gas, a conveyor mechanism provided on the floor portion of the furnace chamber and adapted to move the ceramic articles oppositely to a direction in which the non-oxidizing gas flows through the furnace chamber for firing the ceramic articles; and at least one partition wall with the surface being composed of molybdenum which partition wall is provided at the ceiling portion of the furnace chamber to define a low temperature zone on the inlet side for the ceramic articles and a high temperature zone.

These and other objects, features and advantages of the present invention will be well appreciated upon reading the following description of the invention when taken in conjunction with the attached drawings while understanding that some modifications, variations and changes of the same could be made by the skilled in the art to which the invention pertains without departing from the spirit of the invention of the scope of the claims appended hereto.

BRIEF DESCRIPTION OF THE DRAWINGS

For a better understanding of the invention, reference is made to the drawings in which.

DETAILED DESCRIPTION OF THE INVENTION

Figure 1:
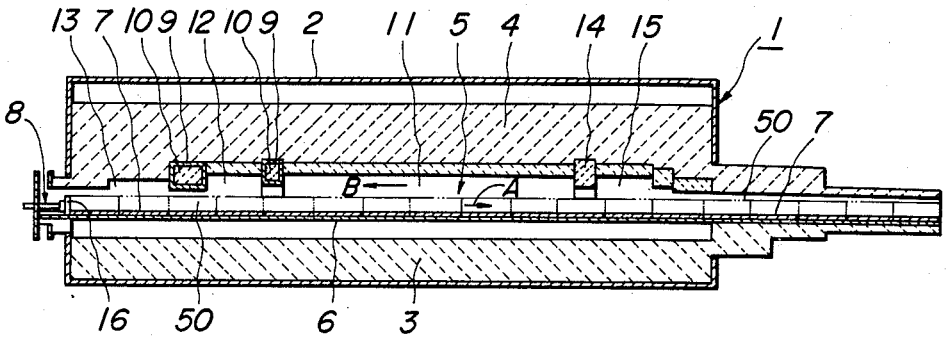
FIG. 1 is a vertical sectional view of an embodiment of the firing furnace according to the present invention.
Figure 2:
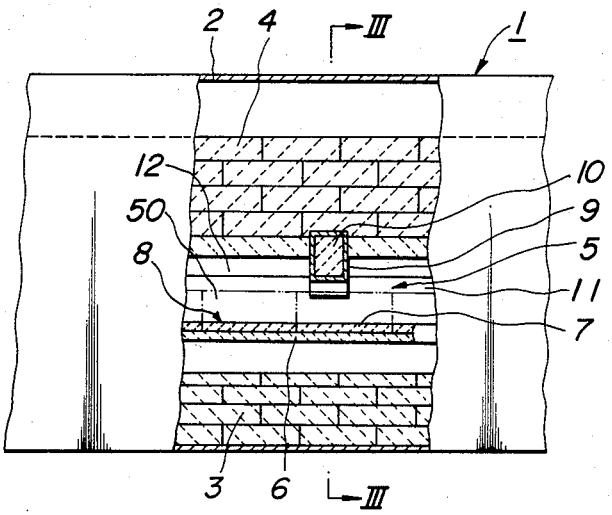
FIG. 2 is a detailed view showing the principal portion of the embodiment in FIG. 1.
Figure 3:
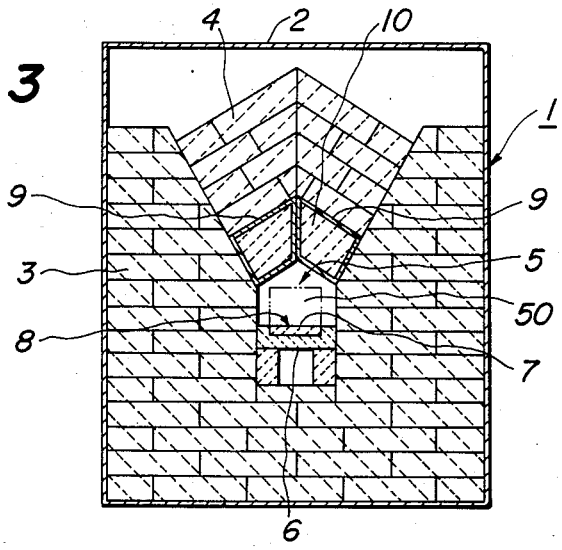
FIG. 3 is a sectional view of the embodiment in FIG. 2 as taken along the line X—X.

The present invention will be described in more detail with reference to the attached drawings.

A reference numeral 1 is a furnace body constructed by piling refractory bricks 3 and ceiling bricks 4 inside a casing 2. A reference numeral 5 is a furnace chamber formed at the central portion of the furnace body 1 over the whole length thereof. At the inside of the furnace chamber 5, the lower face of the chamber 5 is provide with a conveyor mechanism 8 comprising hearth bricks 6 the central upper surface of which is depressed and a movable plate 7 which is adapted to slide on the upper surface of the hearth bricks 6. While an article to be treated, 50, which is a ceramic article, is placed on the upper surface of the movable plate 7, the article to be treated is pushed by a pusher 16 arranged at the left side portion of the furnace body 1 to be intermittently conveyed inside the furnace chamber 5 in a fixed direction shown by an arrow A. A gas supply means (not shown) is provided at the right side portion of the furnace body 1, so that a non-oxidizing gas such as hydrogen gas flows into the furnace chamber 5 in the opposite direction shown by an arrow B to fill the entire furnace chamber 5. At predetermined positions in the ceiling portion of the furnace chamber 5 partition walls 10 are provided. The partition walls are composed of refractory bricks, the surfaces of which are covered with a molybdenum plate 9.

In FIG. 1, the partition walls 10 are projected inside the furnace chamber 5 and near the articles to be treated, 50, to form plural zones 11, 12 and 13 having different temperatures in the furnace chamber 5. The central zone 12 is a zone of highest temperature, and the zones 11 and 13 on the opposite sides thereof are high temperature zones lower in temperature than the zone 12.

In the present invention, at least the surface portion of the partition wall 10 is required to be made of a material which does not react with a vaporized component such as magnesia, silica, etc., produced in the high temperature portion and has a high strength at high temperatures. Therefore, a heat resistive metal such as molybdenum or tungsten is used as the material of the partition wall 10. But, since tungsten is more difficult to be plastically processed and more expensive as compared with molybdenum, molybdenum is preferred.

Furthermore, according to the present invention, the locations and the number of the partition walls 10 provided are not restricted to those as illustrated in FIG. 1, and at least one partition wall 10 is required to be provided in a location at the low temperature zone where ceramic articles are to be introduced and vaporized components produced from the articles to be treated or the refractory bricks in the high temperature zone is condensed.

As shown in FIG. 1, the partition wall 10 is not restricted to the construction that the refractory bricks, preferably, alumina bricks, are covered with the molybdenum plate 9, but, for instance, the partition wall may be a molybdenum plate itself.

As the partition wall 10, a partition wall 14 which is covered with no molybdenum plate 9 is projected in the furnace chamber 5 as shown in FIG. 1, and the zone 15 outside of this partition wall 14 may be designed as a cooling zone.

According to the thus constructed non-oxidized atmosphere furnace of the present invention, while the inside of the furnace chamber 5 is filled with a non-oxidizing gas such as hydrogen gas or the like, and the furnace chamber 5 is heated by an electric heater to give specified temperature patterns to the plurality of zones 11, 12 and 13, separated by the partition walls 10, the articles to be treated, for example, alumina articles, are conveyed in a fixed direction by means of the conveyor mechanism 8. Thus, as in the conventional case, while the articles to be treated are successively passed through the zones with different temperatures, they are continuously fired in the non-oxidizing atmosphere. Further, as in the case with conventional techniques, a very small amount of silica component and magnesia component contained in the articles 50 to be treated and the refractory bricks at the high temperature zone evaporates at the high temperature portion. However, according to the non-oxidizing atmosphere of the present invention, since the surface of the partition walls 10 protrusively arranged in the ceiling portion of the furnace chamber 5 at the specified locations are composed of the refractory bricks, the surfaces of which are covered with molybdenum plates 9, even when the evaporating component moves into the low temperature zone and contacts with the partition walls 10 to be condensed while being carried by the non-oxidizing gas, no reaction takes place between the molybdenum and silica or magnesia. Thus, no impurities are produced through the reaction between the components of the refractory bricks of the partition wall and the evaporating component unlike the prior art. Even if the silica or magnesia condensed on the partition wall 10 falls onto the articles 50 to be treated and moves into the high temperature zone together with the articles 50 to be treated, there is no fear that the article to be treated is contaminated, because the impurities are passed through the high temperature zone together with the articles to be treated and evaporates again.

As obvious from the foregoing explanation, the present invention is to eliminate the influence of the components such as silica or magnesia evaporated from the articles to be treated or evaporated from the furnace material itself. Particularly, the present invention is to provide a firing furnace which is suitable for the sintering of light-permeable translucent alumina ceramics containing magnesia. Further, since the interior of the furnace chamber is divided into a plurality of zones having different temperatures by means of the partition walls, the preferable temperature distribution can be maintained, as in the case of the conventional techniques. Consequently, the present invention is extremely valuable in practical use since it can resolve the problems encountered by conventional non-oxidizing atmosphere electric furnaces of this type.

What is claimed is:

1. A non-oxidizing atmosphere firing furnace for firing ceramic articles, comprising a furnace chamber filled with a non-oxidizing gas, a conveyor mechanism provided on a floor portion of the furnace chamber, said conveyor mechanism moving the ceramic articles opposite to a direction in which the non-oxidizing gas flows through the furnace chamber; and at least one partition wall having at least its surface composed of molybdenum, said partition wall being provided on a ceiling portion of the furnace chamber to define a low temperature zone on the inlet side for the ceramic articles and a high temperature zone.

2. A non-oxidizing atmosphere firing furnace according to claim 1, wherein the partition walls comprise refractory bricks covered with molybdenum.

3. A non-oxidizing atmosphere firing furnace according to claim 1, wherein the non-oxidizing atmosphere gas comprises a reducing gas.

4. A non-oxidizing atmosphere firing furnace according to claim 2, wherein the ceramic articles to be fired consist essentially of alumina and magnesia.

5. A non-oxidizing atmosphere firing furnace according to claim 4, wherein the fired ceramic articles comprise translucent alumina.

6. A non-oxidizing atmosphere firing furnace for firing ceramic articles comprising:

a furnace chamber having a floor portion, side wall portions and a ceiling portion, said furnace chamber being filled with a non-oxidizing gas;

a conveyor mechanism provided in said floor portion, said conveyor mechanism moving the ceramic articles in a direction opposite to the direction that the non-oxidizing gas flows through the furnace chamber; and at least one partition wall extending from said ceiling portion toward said conveyor mechanism and located between said side wall portions, one side of said partition wall facing a high temperature zone of said furnace chamber and an opposite side of said partition wall facing a low temperature zone of said furnace chamber, at least the surface of said partition wall comprising a material selected from the group consisting of molybdenum and tungsten.

7. A non-oxidizing atmosphere firing furnace according to claim 6, wherein said at least one partition wall comprises refractory brick covered with molybdenum.

8. A non-oxidizing atmosphere firing furnace according to claim 6, wherein said at least one partition wall comprises refractory brick covered with tungsten.

9. A non-oxidizing atmosphere firing furnace according to claim 6, wherein said partition wall consists essentially of molybdenum.

10. A non-oxidizing atmosphere firing furnace according to claim 6, wherein the non-oxidizing atmosphere comprises a reducing gas.

11. A non-oxidizing atmosphere firing furnace according to claim 6, wherein the ceramic articles to be fired consist essentially of alumina and magnesia.

12. A non-oxidizing atmosphere firing furnace according to claim 4, wherein the fired ceramic articles comprise translucent alumina.

13. A non-oxidizing atmosphere firing furnace for firing ceramic articles comprising:

a furnace chamber having a floor portion, side wall portions and a ceiling portion, said furnace chamber being filled with a non-oxidizing gas;

a conveyor mechanism provided in said floor portion, said conveyor mechanism moving the ceramic articles in a direction opposite to the direction that the non-oxidizing gas flows through the furnace chamber; and at least two partition walls extending between said side wall portions, one side of each of said partition walls facing a high temperature zone of said furnace chamber and an opposite side of each of said partition walls facing a low temperature zone of said furnace chamber, at least the surface of each of said partition walls comprising a material selected from the group consisting of molybdenum and tungsten.

14. A non-oxidizing atmosphere firing furnace according to claim 13, wherein said at least two partition walls comprise refractory bricks covered with molybdenum.

15. A non-oxidizing atmosphere firing furnace according to claim 13, wherein said at least two partition walls comprise refractory bricks covered with tungsten.

16. A non-oxidizing atmosphere firing furnace according to claim 13, wherein said at least two partition walls consist essentially of molybdenum.

17. A non-oxidizing atmosphere firing furnace according to claim 13, wherein the non-oxidizing atmosphere comprises a reducing gas.

18. A non-oxidizing atmosphere firing furnace according to claim 13, wherein the ceramic articles to be fired consist essentially of alumina and magnesia.

* * * * *